US008840353B2

(12) United States Patent
Hopkins

(10) Patent No.: US 8,840,353 B2
(45) Date of Patent: Sep. 23, 2014

(54) VEHICLE MOUNTED HIGHWAY REFUSE COLLECTOR

(76) Inventor: Walter M. Hopkins, McGaheysville, VA (US)

( * ) Notice: Subject to any disclaimer, the term of this patent is extended or adjusted under 35 U.S.C. 154(b) by 351 days.

(21) Appl. No.: 13/200,138

(22) Filed: Sep. 20, 2011

(65) Prior Publication Data

US 2013/0067667 A1 Mar. 21, 2013

(51) Int. Cl.
*B65G 67/00* (2006.01)
*E01H 1/10* (2006.01)

(52) U.S. Cl.
CPC ..... *E01H 1/106* (2013.01)
USPC ..... 414/338

(58) Field of Classification Search
USPC ..... 15/78, 79.2, 83; 14/338, 474, 373; 37/232, 235, 236, 264, 270, 271; 56/16.4 R, 16.5, 16.6, 17.3, 17.4, 33, 56/34, 35, 40, 228, 327.1, 327.2, 328, 329, 56/341, 367; 414/338, 474, 373
See application file for complete search history.

(56) References Cited

U.S. PATENT DOCUMENTS

| | | | | | |
|---|---|---|---|---|---|
| 2,729,046 | A | * | 1/1956 | Patterson | 56/328.1 |
| 3,777,462 | A | * | 12/1973 | Sharp et al. | 56/328.1 |
| 4,044,422 | A | | 8/1977 | Larsen | 15/340 |
| 4,328,603 | A | | 5/1982 | Dickson et al. | 15/84 |
| 5,087,165 | A | * | 2/1992 | Akel | 414/440 |
| 5,375,402 | A | * | 12/1994 | Gidge | 56/328.1 |
| 5,596,784 | A | | 1/1997 | Tolmachoff | 15/83 |
| 5,745,947 | A | | 5/1998 | Liu et al. | 15/84 |
| 5,806,213 | A | | 9/1998 | Doornek et al. | 37/231 |
| 5,850,656 | A | | 12/1998 | Smith et al. | 15/84 |
| 5,967,554 | A | | 10/1999 | Rea | 280/851 |
| 6,006,390 | A | | 12/1999 | Bischel et al. | 15/82 |
| 6,073,371 | A | | 6/2000 | Goos et al. | 37/232 |
| 6,116,846 | A | | 9/2000 | Bulkley | 414/700 |
| 6,122,797 | A | | 9/2000 | Vanderlinden | 15/346 |
| 6,154,911 | A | | 12/2000 | Vanderlinden | 15/85 |
| 6,163,985 | A | | 12/2000 | Chinnery et al. | 37/234 |
| 6,323,759 | B1 | | 11/2001 | Menze | 340/425.5 |
| 6,351,898 | B1 | | 3/2002 | Lewis et al. | 37/197 |
| 6,560,905 | B2 | | 5/2003 | Monroe | 37/248 |
| 6,574,890 | B2 | | 6/2003 | Bateman, Jr. | 37/264 |
| 6,640,468 | B2 | | 11/2003 | Menze | 37/236 |
| 6,701,646 | B2 | | 3/2004 | Schultz et al. | 37/232 |
| 6,854,157 | B2 | | 2/2005 | Strauser | 15/340.4 |
| 7,028,423 | B1 | | 4/2006 | Curry | 37/236 |
| 7,281,296 | B2 | | 10/2007 | Strauser | 15/348 |
| 7,322,177 | B2 | | 1/2008 | Geraghy | 56/344 |
| 7,530,776 | B2 | * | 5/2009 | Hinds | 414/132 |
| 7,631,442 | B2 | | 12/2009 | Kost et al. | 37/234 |
| 7,654,478 | B1 | | 2/2010 | Lehmann | 241/24.14 |

(Continued)

*Primary Examiner* — James Keenan
*Assistant Examiner* — Glenn Myers

(57) ABSTRACT

The vehicle mounted highway refuse collector gathers discarded refuse from roadway surfaces at normal highway speeds without slowing down. The refuse collector can gather discarded tire treads, or pieces of furniture, and even dead animals at normal speeds safely. At normal highway speeds, the impact with refuse provides centrifugal force sufficient to gather and rotate debris up and onto a storage shelf allowing the continued operation of the refuse collector until it is full. At less than highway speeds, motor assistance provides the means to gather in, and rotate debris onto the storage shelf safely for operation at slower speeds as in city streets. The cleanout when full is facilitated by pull-pins that drop down the storage shelf so as to be easily unloaded.

14 Claims, 8 Drawing Sheets

(56) References Cited

U.S. PATENT DOCUMENTS 7,837,751 B2 * 11/2010 Dunning et al. ..... 55/385.1
2007/0193073 A1 8/2007 Doak ..... 37/270
2008/0263907 A1 10/2008 Winter ..... 37/270
2010/0319224 A1 12/2010 Ghosh ..... 37/270

* cited by examiner

FIGURE 8.
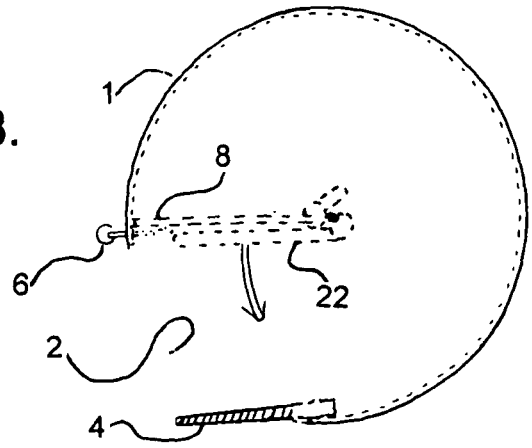
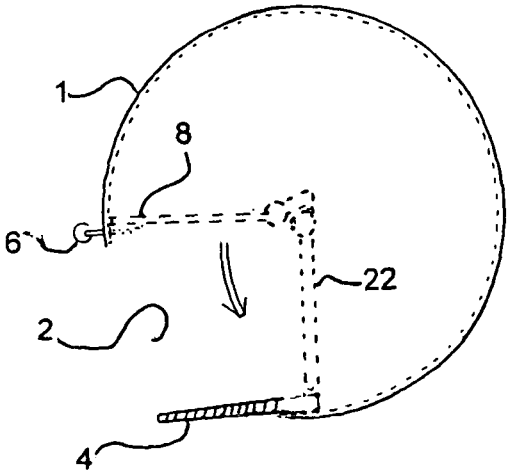
FIGURE 9.
FIGURE 10.
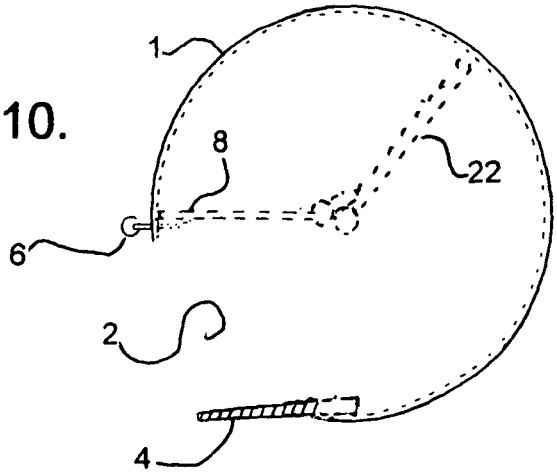

VEHICLE MOUNTED HIGHWAY REFUSE COLLECTOR

REFERENCES CITED

U.S. Patents

| | | | |
|---|---|---|---|
| 7,654,478B1 | Feb. 2, 2010 | Leroy C. Lehmann<br>"Trash Harvester Apparatus & Method" | 241/24.14 |
| 7,631,442B2 | Dec. 15, 2009 | J. A. Kost & R. L. Potak<br>"Modular Hydraulic Power Mechanism" | 37/234 |
| 7,322,177B2 | Jan. 29, 2008 | William F. Geraghy<br>"Machine for Gathering Ground Strewn Articles" | 56/344 |
| 7,281,296B2 | Oct. 16, 2007 | Daniel P. Strauser<br>"Debris Collection Systems, Vehicles, & Methods" | 15/348 |
| 7,028,423B1 | Apr. 18, 2006 | Floyd E. Curry<br>"Snowplow Blade Lifting Mechanism" | 37/236 |
| 6,854,157B2 | Feb. 15, 2005 | Daniel P. Strauser<br>"Debris Collection Systems & Vehicles" | 15/340.4 |
| 6,701,646B2 | Mar. 9, 2004 | Lynn W. Schultz et al.<br>"Spring Bracket Design & Method for Snow Plow Blade Tripping Mechanism" | 37/232 |
| 6,640,468B2 | Nov. 4, 2003 | Peter Menze<br>"Vehicle Mounted Snowplow Impact Monitoring System & Method" | 37/236 |
| 6,574,890B2 | Jun. 10, 2003 | Donald Bateman, Jr.<br>"Combination Snowplow & Bucket" | 37/264 |
| 6,560,905B2 | May 13, 2003 | James Monroe<br>"Device for Removing Snow & Other Debris From Ground Surfaces" | 37/248 |
| 6,351,898B1 | Mar. 5, 2002 | Scott Lewis et al.<br>"Height Adjustment System" | 37/197 |
| 6,323,759B1 | Nov. 27, 2001 | Peter Menze<br>"Snowplow Diagnostic System" | 340/425.5 |
| 6,163,985 | Dec. 26, 2000 | Ronald T. Chinnery et al.<br>"System for Controlling a Snowplow & Other Vehicle Accessories" | 37/234 |
| 6,154,911 | Dec. 5, 2000 | Roger Vanderlinden<br>"Debris Lifting Apparatus for use in a Surface Sweeping Vehicle" | 15/85 |
| 6,122,797 | Sep. 26, 2000 | Roger Vanderlinden<br>"Debris Suctioning & Separating Apparatus for use In a Surface Cleaning Vehicle Having a Recirculating Type Debris Suctioning System" | 15/346 |
| 6,116,846 | Sep. 12, 2000 | Neil Bulkley<br>"Front End Loader Assembly for a Vehicle" | 414/700 |
| 6,073,371 | Jun. 13, 2000 | Mary Goos et al.<br>"Snowplow Assembly with Adjustable-Bias Trip Mechanism" | 37/232 |
| 6,006,390 | Dec. 28, 1999 | Randall J. Bischel et al.<br>"Connecting Mechanism for Attaching a Ground-Engaging Surface Maintenance Implement to a Traction Vehicle" | 15/82 |
| 5,967,554 | Oct. 19, 1999 | Ryan M. Rea<br>"Tire Tread Catcher" | 280/851 |
| 5,850,656 | Dec. 22, 1998 | Owen Smith et al<br>"Highway Debris Entrainment & Storage Device" | 15/84 |
| 5,806,213 | Sep. 15, 1998 | J. R. Doornek & G. E. Lutzke<br>"Rotatable Support Wheels for a Snowplow" | 37/231 |
| 5,745,947 | May 5, 1998 | Kaibai Liu et al.<br>"Automatic Debris Retrieval System" | 15/84 |
| 5,596,784 | Jan. 28, 1997 | David Tolmachoff<br>"Vehicle for Collecting Debris from a Road" | 15/83 |
| 4,328,290 | Apr. 22, 1980 | Donald Dickson et al.<br>"Street Sweeping Machine" | 15/84 |
| 4,044,422 | Aug. 30, 1977 | Gregory Larsen<br>"Sweeper Pickup Hood with Air Lock" | 15/340 |

REFERENCES CITED

U.S. Patents Application Publications

| | | | |
|---|---|---|---|
| 2010/0319224A1 | Dec. 23, 2010 | S. K. Ghosh<br>"Wear Resistant Support Structures for Utility Equipment" | 37/270 |

-continued

| | | | |
|---|---|---|---|
| 2008/0263907A1 | Oct. 30, 2008 | Kent Winter<br>"Road Machinery Blade Wear Resistors" | 37/270 |
| 2007/0193073A1 | Aug. 23, 2007 | B. A. Doak<br>"Snow Plow Dolly" | 37/270 |

FIELD OF SEARCH

This is a search for a vehicle with a front mounted device that is a large specially designed cylinder that can gather highway debris and refuse, including the broken off truck tire treads [called 'gators'], and dead animals, and discarded furniture—all that lie upon the highway surface. The large cylinder type is to be operable at full highway speeds, including the Interstate Highways, without slowing down, and it is able to gather debris and refuse from the road surface without restricting or closing the lane from normal traffic.

The search classes closest to this 'Vehicle Mounted Highway Refuse Collector' seem to be in the field of snowplows, street sweepers, excavators, and article handlers and/or package carriers, and possibly in land vehicles. As prior art, these classes offer the most relevance and correlation to this unique invention, and the search thus incorporates these classes for any related or relevant art.

In Class 37: "EXCAVATING", the most relevant art, for example, is found in the sub-classes /232 ".Vehicle mount with obstacle responsive trip, or yieldable tool [eg., brush]; /235 "Vehicle mount including power lift"; /236 " . . . Power means is hydraulically actuated piston"; /264 ".Scoop"; /270 " . . . Mounted on surface contacting support or guide"; /271 " . . . For adjusting height of blade.

In Class 15: "BRUSHING, SCRUBBING, AND GENERAL CLEANING" wherein the sub-classes would include /78 " . . . Street sweepers"; and /83 " . . . Collector" both seem the best of this street cleaner and rotary brush that concern some features of this invention.

A similar possibility of this type is in the classification art in CLASS 414: "MATERIAL OR ARTICLE HANDLING" wherein in the 'subs'/373 "LOAD TRANSPORTING TYPE VEHICLE AND EXTERNAL MEANS COOPERATING IN THE LOADING AND UNLOADING THEREOF".

Another possible cross reference is found in the classification art in CLASS 280: "LAND VEHICLES" and in the 'subs' 700 series, and somewhat in the 800 series wherein the most relevant would be: /727 " . . . Attachment"; /743.1 " . . . Specific confinement structure"; /784 "Having impact absorbing means"; /805 " . . . With energy absorber"

The relevant art in classification is somewhat listed herein, but it is by no means complete enough for this unique device for refuse collection that involves elements from the many cited prior art patents referenced herein.

BACKGROUND OF THE INVENTION

The 'Vehicle Mounted Highway Refuse Collector' presents a unique and non-obvious means to clear the highways and Interstates of refuse at highway speeds without any requirement to cordon off a section of the roadway. This refuse collector is designed to collect tire treads that have come loose from vehicles, and the furniture pieces fallen onto the roadway, and even the dead animals killed on the roadway wherein all such items would be collected and stored for later cleanout, and all of these items without slowing down. Centrifugal force drives the object around the inside of the collector cylinder onto a storage shelf to be retained until the shelf is full, and then taken by the vehicle to a cleanout station. The impact of these objects provides the requisite force, and the operator has a viewing window to see when the shelf is full, and cleanout is needed. The gathering of these objects is very much like the work of a snowplow is its impact and function, but in this configuration it is a good deal faster and at higher speeds.

Snowplow means that are cited as prior art contain features that allow the blade of the plow to scrape the surface of a roadway, and the blade's management of impacts with fixed objects, and on some the use of wheels and skids to keep the plow blade just above the hard surface of the road to reduce wear. In many of the examples of the prior art the elements and features used in snowplowing are germane to this invention in selected relevant items as to be discussed to follow:

Citations for these U.S. Patents concerning snowplows are on the opening Reference Page:

| | | | |
|---|---|---|---|
| 7,028,423 | Apr. 18, 2006 | Curry | 37/236 |
| 6,701,646 | Mar. 9, 2004 | Schultz et al. | 37/232 |
| 6,640,468 | Nov. 4, 2003 | Menze | 37/234 |
| 6,574,890 | Jun. 10, 2003 | Bateman, Jr. | 37/264 |
| 6,560,905 | May 13, 2003 | Monroe | 37/248 |
| 6,351,898 | Mar. 5, 2002 | Lewis et al. | 37/197 |
| 6,323,759 | Nov. 27, 2001 | Menze | 340/425.5 |
| 6,163,985 | Dec. 26, 2000 | Chinnery et al. | 37/234 |
| 6,073,371 | Jun. 13, 2000 | Goos et al. | 37/232 |
| 5,806,213 | Sep. 15, 1998 | Doornek et al. | 37/231 |

In the first cited patent of inventor Floyd E. Curry [ . . . 423] examples are shown and described on the lifting up means of the snowplow blade, and the tripping spring means when the blade strikes a fixed object, and the spring pressure means to keep the plow's weight as a force to scrape the roadway. While this invention in application does not use such means directly, they do offer concepts of the blade operation that is similar to the refuse collector.

In the second cited patent of inventors Lynn W. Schultz, Timothy G. Koch, and Terry C. Wendoff [ . . . 646] a better means in the use of 'trip' springs is shown, and the support means to contain the forces when the blade strikes a fixed object. While in this application the use of a system of trip springs is used, but their this unit is heavier and requires a heavier support system, thus, the refuse collector is not a lighter blade but uses the spring means for protection from fixed objects, and in the general operating structure for protection of the equipment. These trip springs are then not claimed in this patent application.

In the third cited patent of Peter C. Menze [ . . . 468] and again in his seventh cited patent [ . . . 759] Inventor Menze concerns the operation and management of the snowplow and shows unusual means to set the height of the blade and its resultant pressure to scrape snow from a roadway; and in the patent . . . 759 is shown the complete operating and attachment assembly for a snowplow that is somewhat as in this refuse collector, but he is concerned with the diagnostic and connection system for a plowing vehicle and most importantly when a problem occurs warning the vehicle's operator. It would seem that some features of Inventor Menze's patents [and his other patents also] do offer better control of any such 'pushing' device, and as such, can influence the operation and the use of this refuse collector, but no direct citation or claim for such is in this patent application.

In the fourth cited patent of Donald A. Bateman, Jr. [ . . . 890] wherein a curved blade is designed to perform as a bucket to lift snow shown attached to a specialty vehicle seen as a 'front end loader', and in Inventor Bateman's drawings the bucket is shown as a competent loader bucket with 'wear' plate means available. Features as shown in his patent would influence the use of a 'bucket' to clear away snow, but his vehicle as shown is not designed for highway or Interstate speeds, and in this patent application such speeds are normal and essential to the centrifugal forces available. Inventor Bateman's design is more for clearing out a vehicle parking lot, lifting up and transferring snow, typical for a front end loader, and not for any service intended in this patent application.

In the fifth cited patent of James C. Monroe [ . . . 905] wherein is seen a small supporting wheel that can help carry the weight and can dictate the clearance over the surface, and all is within an enclosed body that covers to working members for safety. Additionally, Inventor Monroe uses stiff replaceable fingers as in a stiff brush to grasp and propel snow and/or debris into a discharge tube to be expelled from the device. While the support wheel and the enclosure means is shown in this patent application, the use is just accommodating and no direct claim for such means is sought in this patent application.

In the sixth cited patent of Scott Lewis, Mike Weege, and Greg Noah [ . . . 898] wherein is seen a simple but seemingly effectively lever shaft that measures and senses the height selected by an adjustable rotating nut as set by the operator of the vehicle performing the work of snowplowing. While in this invention application, the height of the supporting wheels can be adjusted if requisite, there would be no sensor means, just mechanical adjustment, and thus, there is no claim for such sensor/indicator uses.

The seventh cited patent was discussed in Menze's patent number three.

In the eighth cited patent of Ronald Thomas Chinnery and Lynn Edon Richardson [ . . . 985] wherein the position control for lifting, adjusting, or turning the snowplow is set inside of the vehicle's cab for ease of selection and remote operation, and these are detailed and described in depth in their patent. In this invention patent application controls are employed that are basic and as needed for work, and no claim ensues from Inventors Chinnery's and Ms. Richardson's work In the ninth cited patent of Mary Goos et al. [8 others listed] [ . . . 371] wherein a spring means is seen compressing upon an impact with a fixed object, and the visuals in the drawings are impressive showing the impact and spring forces. This patent of Inventors Goos and others shows the need for impact protection and means, but in our invention being applied for as seen in FIG. 5, the springs would extend upor impact with a fixed object and not compress.

In the tenth cited patent of James R. Doornek and Gerald A. Lutzke [ . . . 213] wherein when a vehicle is detached from its snowplow that these rotatable support wheels and/or skids swing to support the detached weight of the snowplow. What is seen in this invention patent application would be the support wheels/skids being in place for the time of operating the refuse collector, and they would remain in place when the refuse collector is detached to continue its support.

Citations for these U.S. Patents with rotating brushes and ground surface collecting and cleaning means are from the Reference Page:

| | | | |
|---|---|---|---|
| 7,654,478 | Feb. 2, 2010 | Lehman | 241/24.14 |
| 7,322,177 | Jan. 29, 2008 | Geraghty | 56/344 |
| 7,281,296 | Oct. 16, 2007 | Strauser | 15/348 |
| 6,854,157 | Feb. 15, 2005 | Strauser | 15/340.4 |
| 6,154,911 | Dec. 5, 2000 | Vanderlinden | 15/85 |
| 6,122,797 | Sep. 26, 2000 | Vanderlinden | 15/346 |
| 6,006,390 | Dec. 28, 1999 | Bischel et al. | 15/82 |
| 5,850,656 | Dec. 22, 1998 | Smith et al. | 15/84 |
| 5,745,947 | May 5, 1998 | Liu et al. | 15/84 |
| 5,596,784 | Jan. 28, 1997 | Tolmachoff | 15/83 |
| 4,328,290 | May 11, 1982 | Dickson et al. | 15/84 |
| 4,044,422 | Aug. 30, 1977 | Larsen | 15/340 |

In this classification—mostly, street sweepers—any such relevant features shall be divided into categories for convenience and expedience with the first being front loading vehicles and systems. In any and all of these devices and machines, the operational speeds are to be low, typically, as in city streets and parking lots, and not at the higher speeds of the refuse collector that can operate even up to the interstate speeds of 65 to 75 miles per hour.

Selected in category one would be the U.S. patents of Leroy C. Lehman [ . . . 478]; and Kaibai Liu et al. [ . . . 947]; and then David Tolmachoff [ . . . 784] wherein all are front loading machines, " . . . 478" presents a full service trash harvester comprising gleaning, sorting, shredding, and storage means all in one environmentally friendly device; and then " . . . 947" assigned to The Toro Company with rows and rows of resilient fingers gleaning and directing trash into its collector drum with the means to deliver its trash into a storage hopper for transport and eventual clean-out; and finally, " . . . 784" wherein in addition to resilient fingers is seen, paddles, sweeps, rotary rakes visible to the operator in a boom system that sweeps, cajoles, and gathers all that it can to convey into rearward storage hopper for transport and clean-out. All of these devices show ingenuity and innovation in a high degree, but, of course, none can match what is being applied for here.

In the next category is seen " . . . 177" demonstrates skillful approaches to gathering and gleaning material off of the ground with steel tines as a rake as it is moved along the ground and then fed onto a conveyor system that in turn delivers the trash into a storage hopper for later disposal. This clever device is not shown nor described a push-along or pull-along, and it even includes a rotary brush to spin off the dirt/earth accumulated in its operation. In the patent " . . . 296" an efficient device includes filters and a vacuum assembly to clean up the gathered trash, and is installed on a specialty vehicle designed for a slow speed operation, typically, a parking lot. In the third cited example, " . . . 390" a front end loader as seen in other patents to power the push unit with a large rotary brush, but in this patent the use of hydraulic power is shown from a powered pump to ancillary hydraulic motors operating selected features of this machine, and this use of a support wheel under the unit to help carry the weight and position the brush surface to its work surface. Selectively, some elements and features can be seen in this invention application, and as such would also be in use in many other machines similar, but these are not claimable in this application.

In the final category is seen many patents that are positioned under and in the middle of the collecting vehicle. The patent " . . . 157" includes environmentally friendly means of a vacuum and of filtering wherein the material collected is contained in a safe and up-to-date manner for disposal. In " . . . 911" the system of rotary brush sweeping the ground is using mechanical means to gather and collect; and in " . . . 797" of the same inventor, Roger Vanderlinden of Canada, the brushing system is using air means to gather, collect and propel debris into the storage hopper provided. In " . . . 656" a centralized 'collector roller' that serves to gather debris off of the road surface and then deliver same to a collector hopper by the means of specialized rubber fingers that are gleaned of their debris. In " . . . 603" a rearward gathering means is provided upon a vehicle, and various hydraulic motors are available to actuate and serve to deliver the road debris into a storage hopper. In " . . . 422" an air recirculation pickup hood gathers the road debris and continuous air delivery moves the debris into the storage hopper. What these prior art examples provide would be seen in various details used in other patents, including to some extent in this NPA, but all deliver their gathering services at low speeds and cannot serve at highway speeds. What can be discerned from such prior art is of interest, but as such, none can be claimed in the application.

In the several remaining prior art patents cited, there are features of interest to show examples of the art in servo systems and one example of an entrainment means. In U.S. Pat. No. 7,631,442 issued Dec. 15, 2009 to James A. Kost & Robert L. Potak, both of Ohio, and assigned to Louis Berkman Winter Products Company of Cleveland, Ohio wherein examples of the uses for hydraulic power to lift, to move around, to support at rest, and to tilt as needed are shown. The hydraulic power assembly is well presented and packaged and put to use, but it is not different from the many uses of such seen today. The inventors in their FIG. 12 show details of 'in-cab' locations for the controls to activate their snowplow system, and again while well presented, such can be seen in commercial units available on the market today, and of course would not be claimable in this application.

In U.S. Pat. No. 6,116,846 issued Sep. 12, 2000 to Neil Buckley of Pennsylvania, and not shown assigned wherein an extensible and articulating framework is shown that projects forward of a vehicle supporting a 'front end loader' assembly that by hydraulic control means can be lifted and then dumped. What is of interest here is the type of bucket enclosure, and attachment to vehicle, and the various hydraulic servo systems to perform the work. However, as previously stated, none are claimed herein.

Now, for the best of prior art, the "Tire Tread Catcher", a real time example of one function of the 'Vehicle Front Mounted Highway Refuse Collector', as the capture of thrown off tire treads wherein Inventor Ryan M. Rea has U.S. Pat. No. 5,967,554 issued Oct. 19, 1999 shows an entrapment means consisting of a "canister that catches tread as they are thrown off tire[s] and a housing surrounding the tire[s] to funnel and direct tread and road debris to the canister. The canister is attached to a truck or trailer undercarriage adjacent to and right behind the tires." [source: Abstract, lines 1-5] His is an invention not seen today as the enclosure would be bulky and awkward, and the chance of really catching a torn off tread would be small, and the additional cost would be high, and so, it is not a strong factor in the marketplace. In this invention application, not only are loose and torn off tire treads sought, but other debris as well, including dead animals killed on the roadway, and other items, such loose pieces of furniture, or scrap discards, and such that falls out upon a highway or Interstate.

In the Patent Application Publication 2010/0319224 issued Dec. 23, 2010 to Syamal K. Ghosh, and not shown assigned, entitled: "Wear Resistant Support Structures for Utility Equipment wherein a rolling beveled support is shown, also known as a 'shoe' as described in the snowplow and blade patents that lifts the blade up somewhat above the road surface and helps bear the heavy weight. Inventor Ghosh improves the known art and offers wear resistant 'ceramic' as an insert to extend the useful life of this element. Although this invention is far heavier than his cited utility equipment, the lift of the equipment above the road surface is accomplished by strong wheeled assemblies, and thus has been developed beyond the 'shoe' herein shown.

In the Patent Application Publication 2008/0263907 issued Oct. 30, 2008 to Kent Winter, and not shown assigned, entitled: "Road Machinery Blade Wear Resistors" wherein "Each replaceable wear part can comprise a hard, impact resistant metal of high shear strength having at least one cavity filled with an abrasion resistant weldment or resistor." [source: Abstract, lines 6-9] Inventor Winter shows a good means to reduce undue wear, but wherein in this invention the heavier weight and higher speed of operation has dictated the use of wheeled assemblies.

In the Patent Application Publication 2007/0193073 issued Aug. 23, 2007 to Bernard A. Doak, and not shown assigned, entitled: "Snow Plow Dolly" wherein one among the many similar devices are to be seen in the patent prior art, such is shown added outside of the plow blade assembly, and of a thin hard wearing type that can cut through the snow on a roadway keeping the blade elevated sufficiently above the road surface and help bear some of the weight of the blade. Inventor Doak's device does aid the operation of a snowplow blade, wherein in this invention application the considerably heavier weight and the high speed operation requires larger high tires and wheels to perform its work of refuse collection.

In this invention application, all sorts of debris, even bulky items can be managed at highway speeds, and saving the time and risk of cordoning off a lane of high speed traffic. Needless deaths occur every year involved with the management of the highway trash removal, and time and equipment lost being involved with such trash removal, and in this unique and non-obvious invention there is an expedient solution without such deaths and risks. Consider the descriptions and drawings of the invention to follow that will show how such an accomplishment is achieved.

SUMMARY OF THE INVENTION

This invention is a 'Vehicle Mounted Highway Refuse Collector' that can operate effectively at highway speeds collecting refuse from the roadway surface, including the difficult truck tire treads that randomly come off from truck tires. A vehicle mounted highway refuse collector thus comprises the means to gather refuse from a highway while the propelling vehicle is moving. The highway speeds can range from a low of 35 miles per hour [mph] to the Interstate speeds of 65 mph, even up to 75 mph. in some areas. The refuse collector comprises the means to collect such refuse while the propelling vehicle is moving at normal highway speeds.

The refuse collector can be adjusted for its optimal performance and road surface clearance as it comprises a supporting means adjustable over the highway surface by comprising an independent wheeled means. The refuse collector further comprises the means to gather refuse from the highway surface at normal highway speeds without requiring any additional safety means and safety precautions. These higher speeds should utilize the larger series of truck capable of collecting refuse on an Interstate highway at the higher speeds without problems to manage the impact force of the heavier debris encountered. The ability to continue working normally at these speeds offers great safety to the highway workers as no special marked off section of the roadway would be necessary. This invention offers a safe means of collecting refuse and debris from roadways since the collecting of discarded tire treads and most major debris, and the heavier discards of furniture, and even dead animals often found on these roads, presents a great danger to the motorist. This safe and expeditious removal of refuse would prove a blessing to motorists on these high speed roads, as impacts of such to normal vehicles can be disastrous The refuse collector comprises the means of storing refuse while the vehicle is moving at normal highway speeds. The basic embodiment of this refuse collector is very efficient as it collects and stores its debris until it is full, and then it is taken to a designated refuse dumping station or trash collection center to be emptied. The collector would have a viewing window, or video means, that allows the operator to see when it is full and ready to be emptied. The refuse collector can then be lifted up off of the highway to be driven to the designated unloading area.

The force from the vehicle driven even at moderate speeds will supply enough energy to impact and rotate the refuse into the receiving container, and then centrifugally around the outside wall of the container onto the storage one-way shelf system that holds the refuse until it is to be emptied. The refuse collector comprises a means to cleanout the stored refuse when required. It is emptied by the means of the two pull-pins located on the front of the unit [as seen in FIG. 1] wherein this storage shelf drops down and opens up onto the skid plate that is located at the front of the unit. This storage shelf hinges at near the center of the collector cylinder and it rotates downward at the front of the unit to spill or empty out the refuse that has been collected. Also, the collector cylinder can be raised by some amount to facilitate any refuse removal. This is a much desired feature when emptying out dead animals and such that has been collected from the highway surface, as such a procedure makes the emptying and cleanout easy and safe.

In its operation, this refuse collector is much like operating a snowplow wherein the blade is left riding upon the surface of the highway while plowing the snow away. There are upgrades in the means to lift this highway scraper section somewhat up and off of the road surface, and as mentioned earlier, the refuse collector comprises a supporting means adjustable over the highway's surface comprising an independent wheeled means. Additionally, this lower scraping section in this invention can be replaced if worn, or damaged.

A vehicle mounted highway refuse collector comprises the means of absorbing impacts to the refuse collector while the propelling vehicle is moving along the highway at speed. The tipping action seen in snowplows when striking a fixed object on the roadbed is provided in this invention for the refuse collector to minimize damage to the pickup 'skid' plate [best seen in FIGS. 1 and 3] when striking a fixed object in the roadbed. Such impact provisions are also provided to dampen and ameliorate the sudden force that heavy, or bulky, objects will have upon the refuse collector system and its supporting vehicle. Care has been taken to consider impacts, and undue wear, on this invention—the refuse collector—and on its mountings in its operation in every day use. The basic embodiment would provide a simple and straight forward highway refuse collector, and it provides safety and convenience in its mode of operation.

The refuse collector comprises impact resistant, durable material comprising singly, and in combinations, but not limited to:

a. iron;
b. iron alloys;
c. steel;
d. steel alloys;
e. metal;
f. metal alloys;
g. composites of metals;
h. plastic[s];
i. plastic composites;
j. carbon fiber composites;
k. other derivative composites.

A vehicle mounted highway refuse collector comprises the means to gather refuse from highway surfaces while the propelling vehicle is moving at less than normal speeds. The refuse collector comprises the means to gather most major debris from the highway surfaces when at less than normal speeds. In these slower speed operations, more typical to a city street than a highway, the centrifugal force of the highway impact is replaced by motor means, most often, but not limited to, hydraulic power means. The refuse collector comprises motor powered articulating sweeping arms in the front of the refuse collector to gather refuse when at less than normal speeds. The refuse collector further comprises an interior framework means comprising a motor means to rotate the refuse swept into the collector upward onto the storage shelf when at less than normal speeds. The refuse collector then comprises the means of storing the refuse while the propelling vehicle is moving at less than normal speeds. The refuse collector further comprises a visual means, either by direct sight, or by remote video means, to ascertain when the cleanout of the stored refuse is needed.

As this highway refuse collector can be operated at normal highway speeds, there is no necessity or requirement for the usual safety means requiring safety cones and safety methods to cordon off one-lane of the highway or Interstate for the cleanup of refuse and debris. This invention provides a new and safe means to collect refuse off of a regular highway or Interstate that is outstanding in convenience and in safety. This novel means is provided at highway speeds by the operation of a standard truck in a routine manner safely and quickly.

This 'Vehicle Mounted Highway Refuse Collector' provides many sound and desirable features, such as:

a. collecting refuse while moving;
b. moving at normal highway speeds;
c. moving at less than normal speeds;
d. collecting dead animals while moving;
e. collecting discarded tire treads while moving;
f. gathering most major debris while moving;
g. storing the debris/refuse while moving;
h. no external safety precautions required;
i. no interruption of highway traffic;
j. easy and safe means to empty refuse when full;
k. a visual means to see when full of refuse;
l. independent wheels to support refuse collector;
m. independent wheels are adjustable;
n. a replaceable skid plate on collector;
o. means to absorb impacts while moving.

Thus, it is the intention for this invention to offer and to accomplish these goals in the routine operation day to day with its means to collect such debris from the active highways and Interstates at normal speeds without undue interruption or risk. Additionally, for the slower speeds and in-town operations, consider the embodiments to follow that can introduce the requisite means to offset the centrifugal forces involved at the higher speed operations by motor powered means.

My invention is novel and unique in its field of operation, and it non obvious to those skilled and practiced in such arts. Consider the detailed descriptions and the drawings to follow that give a complete view of this new invention.

IN A FURTHER EMBODIMENT

It would not be the scale or size of any lower speed 'Refuse Collector', but rather the loss of the highway speed collection force that will need to be offset. Whereas, the centrifugal impact force sustains the highway speed collection, in a city environment or similar lower speed applications typically below 50 or 40 miles per hour [mph] that will require an offsetting modification in the collection of debris as herein outlined.

The first compensating device would be a means to sweep into the mouth of the 'Refuse Collector' any such debris to be gathered as the centrifugal force is not present. The sweeping means would be hydraulically powered and activated as needed to draw in the debris to the collector. In most embodiments there would be a universally swiveling wheel assembly or an equivalent 'skid' device that would be desired to keep the sweeping arm riding above the direct roadway surface.

The second compensating device would be a means to rotate any gathered items onto the storage shelf for collection and later removal/cleanout. As the storage shelf is larger than the midpoint of the collector drum/container in the high speed device, but at the lower speed a hydraulically powered rotating means would be needed to serve the function of rotating the debris up onto the storage shelf. This impetus in the gathering of debris would require a hydraulic powered means to operate its rotation to accomplish its task, and its return at rest for later debris as received during the 'Refuse Collector's' routine gathering operation. The cleanout after service would be much the same by pulling out the retaining pins to drop down the debris from the storage shelf for removal.

These additional elements are all that would be needed for such lower speed operation in gathering debris, and these hydraulic powered means are well within the normal use and functions of the hydraulic pump already available on the 'Refuse Collector' for its normal operation. The teaching of such functions can be seen in the drawings to follow, FIGS. 6 through 10.

BRIEF DESCRIPTION OF THE DRAWINGS

FIG. 8 shows a side view of the refuse collector wherein below the storage shelf is the rotating framework that can drop down to gather the debris and rotate the debris around inside of the collector up toward the storage shelf.

FIG. 9 shows a side view of the above rotating framework having dropped downward to gather the debris encountered from the skid plate to be rotated up toward the storage shelf.

FIG. 10 shows a side view of the above rotating framework having rotated the debris encountered upward to be placed upon the storage shelf for later cleanout.

AN INDEX OF NUMBERS AND DESCRIPTIVES AS USED IN THE DRAWINGS

Figure 1:
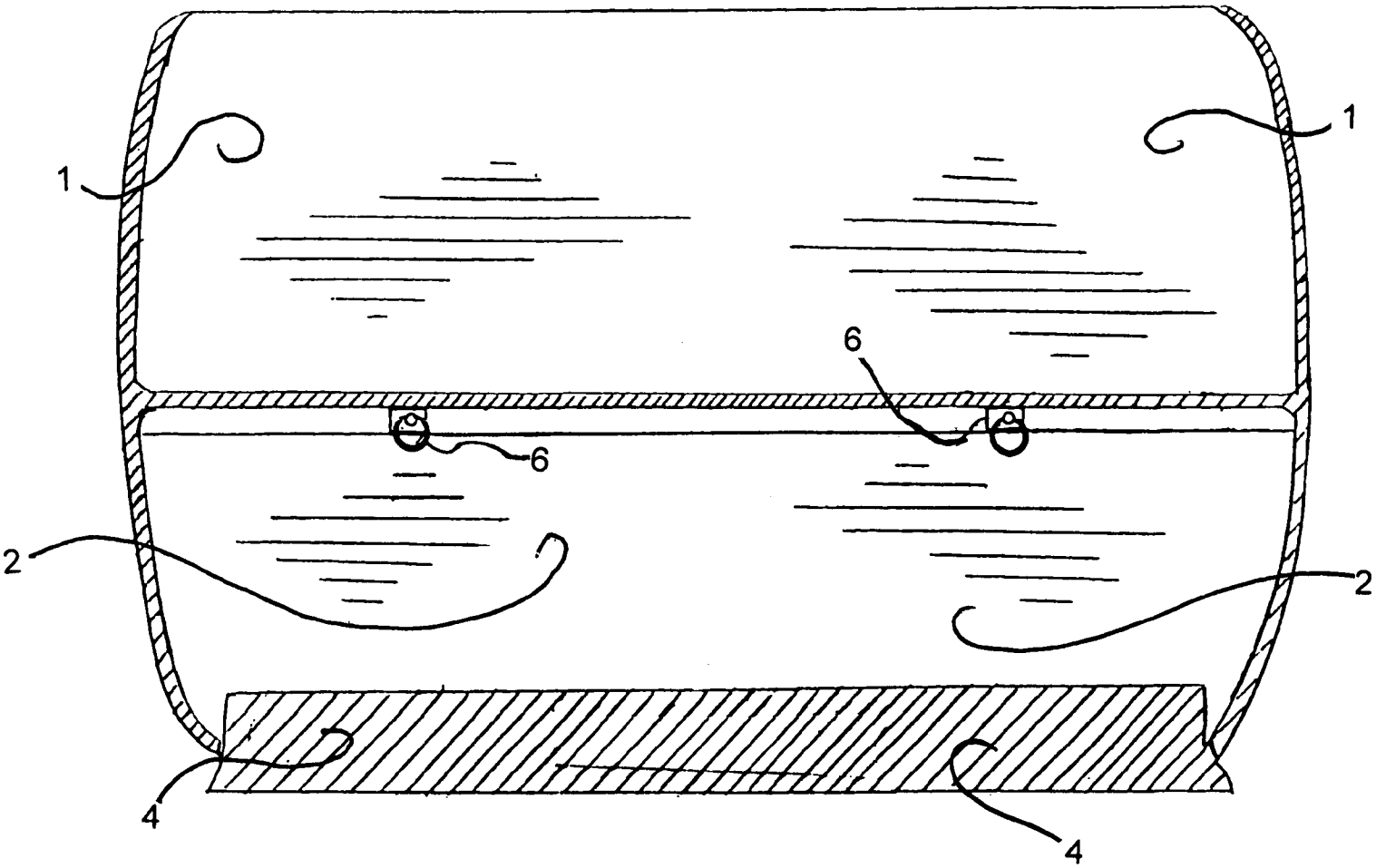
FIG. 1 is a front view of the 'Vehicle Mounted Highway Refuse Collector' that shows the front opening to the large cylinder that is the refuse collector, and the pull-out pins that allow the refuse collector storage shelf to empty out onto the skid plate for cleanout, and the skid plate shown at the lower edge of the cylinder that collects refuse off of the highway.

1 "The Vehicle Mounted Highway Refuse Collector"
2 The opening to collect refuse
4 Highway surface pick-up skid plate
5 Height adjustment means for the skid plate
6 Pull-Pins that drop the inside storage shelf for cleanout
8 The inside storage shelf
10 Shock absorber to reduce impact forces
12 Refuse collector support wheels
13 Smaller wheels/skids for sweeps
14 A viewing window for vehicle operator to see when full
15 Remote video viewing means
16 Hydraulic power supply device
17 Hydraulic fluid lines
18 Hydraulic motor that provides actuation means
20 Sweep arms that gather and can rotate debris into collector
22 Framework that rotates to gather debris to be placed upon storage shelf

DETAILED DESCRIPTION OF THE INVENTION AND DRAWINGS

The initial view of this 'Vehicle Mounted Highway Refuse Collector' [1] is a front, direct, and head-on view seen in the FIG. 1. This is a device that is propelled by a vehicle at its front to operate at full highway speed without slowing to approach and gather road debris in its front opening [2]. The refuse collector is shown with a skid plate [4] at its lowest point that will impact the refuse and propel it into the opening [2] provided to receive such refuse.

Figure 2:
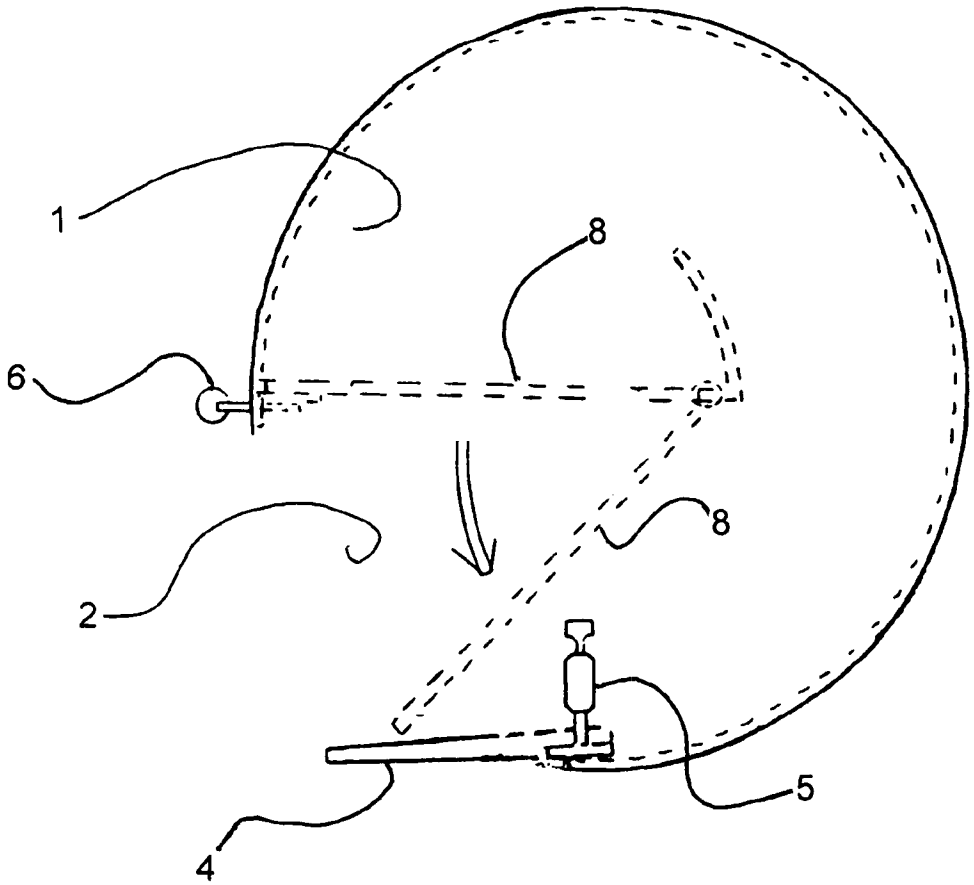
FIG. 2 is an end view of this refuse collector cylinder that shows the front opening at the lower section of the cylinder, and the lower edge skid plate shown with its shock absorbing adjuster attached to it. The refuse rotates dynamically by centrifugal force onto the upper refuse storage shelf that can be emptied for cleanout by rotation downward onto the skid plate when the retaining pins are pulled out.

As is shown in both FIGS. 1 and 2, the 'pull-out pins [6] are located at the front of the refuse collector wherein these pins can be pulled clear of the framework to release the interior storage shelf [8] shown in FIG. 2, so that this shelf drops down upon the skid plate [4] to be cleaned out easily In FIG. 2, a side view of the refuse collector shows the interior storage shelf [8] that the impact centrifugal forces from the opening [2] will rotate the refuse and debris around the collector [1] onto the storage shelf [8]. Once again, the pull-out pins [6] are shown that release the shelf [8] for cleanout upon the skid plate [4]. An adjusting device [5] is shown that can serve to raise or lower the skid plate [4] for its optimal service.

Figure 3:
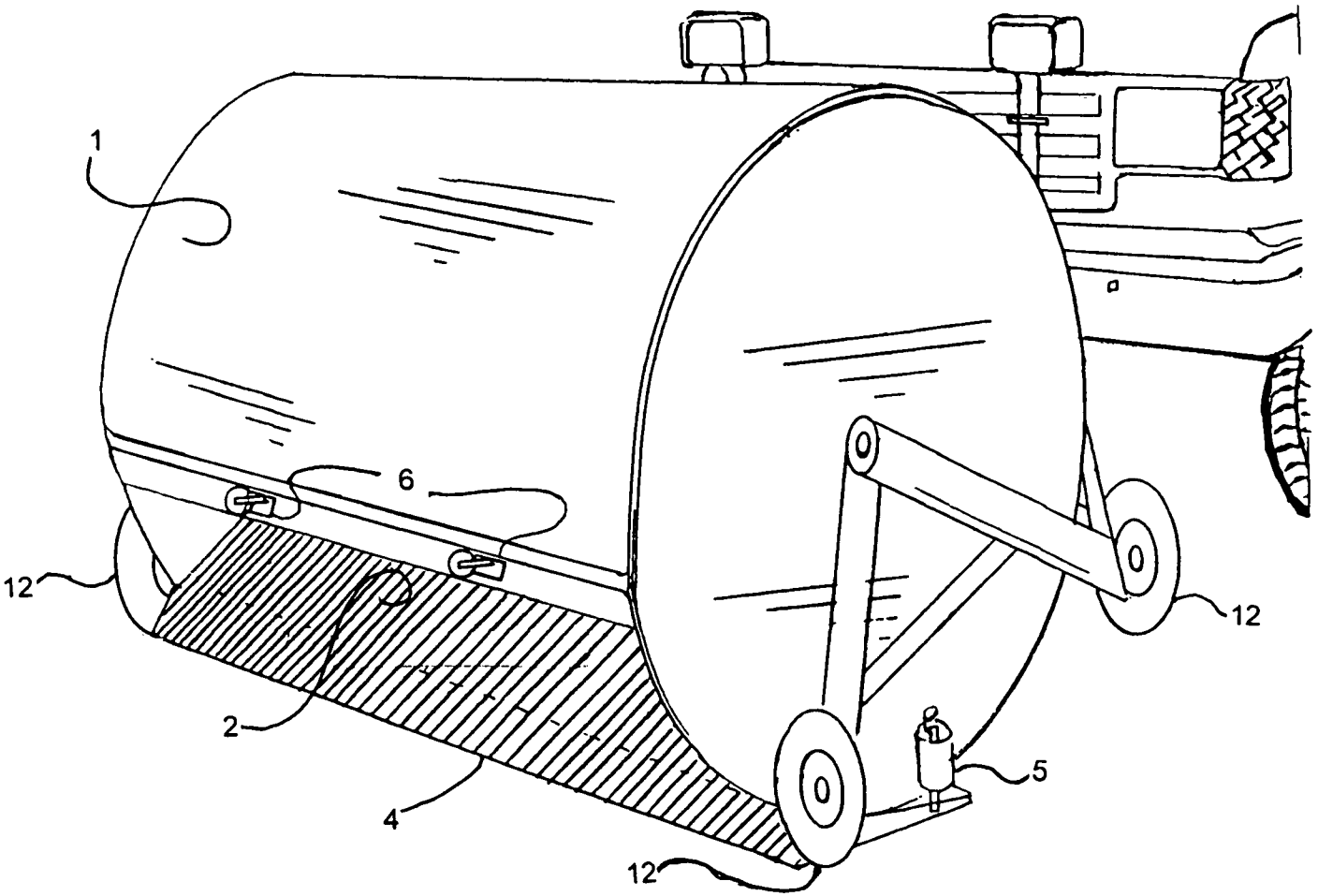
FIG. 3 is a front oblique view of this refuse collector cylinder mounted on the front of a truck ready to be put to work.

A full oblique view of the refuse collector [1] is seen mounted on the front of a truck for routine operation in the FIG. 3 wherein in addition to the above items, the supporting wheels [12] can be seen that ease the weight and the optimal clearance for the over the road operation at speeds. In the FIG. 3 is shown the largest size operational refuse collector [1] for normal highway speeds. Additionally, the largest size can remain on the road longer as its collection and storage means is larger.

Figure 4:
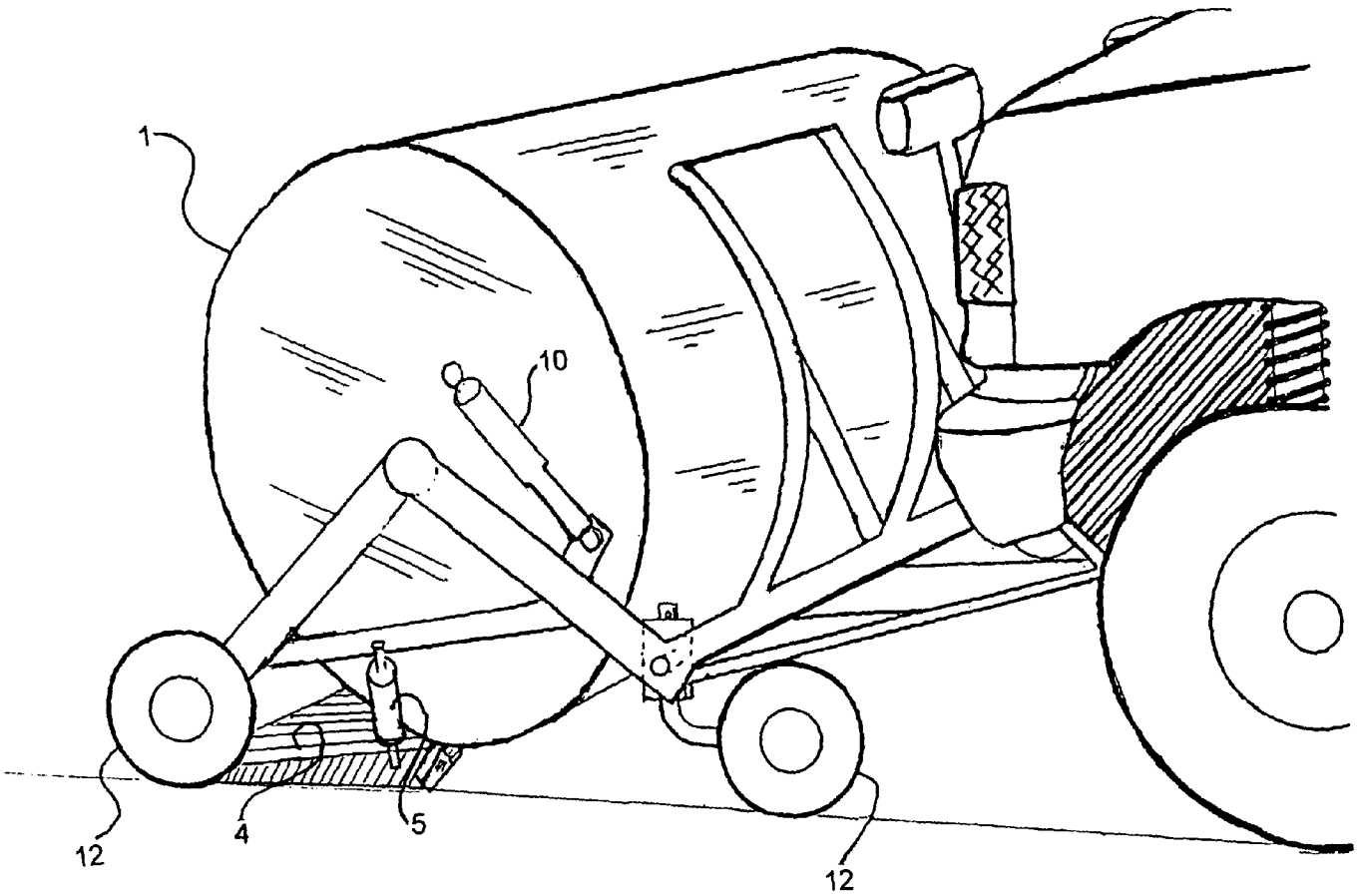
FIG. 4 is a rear oblique view of this refuse collector cylinder shown mounted in front of a truck.

In a side oblique view of the refuse collector [1] seen in FIG. 4, the addition of an impact absorbing shock absorber [10] for encountering fixed or immovable objects on the road surface. Also seen here is the wheeled support [12] wherein at the rear an articulating means is shown for the wheel to rotate and follow the direction as being driven by the propelling vehicle. The set of front wheels [12] would be provided [not shown] with universally swiveling/rotating mountings as the lead wheels [12] for the operation over the roadway.

Figure 5:
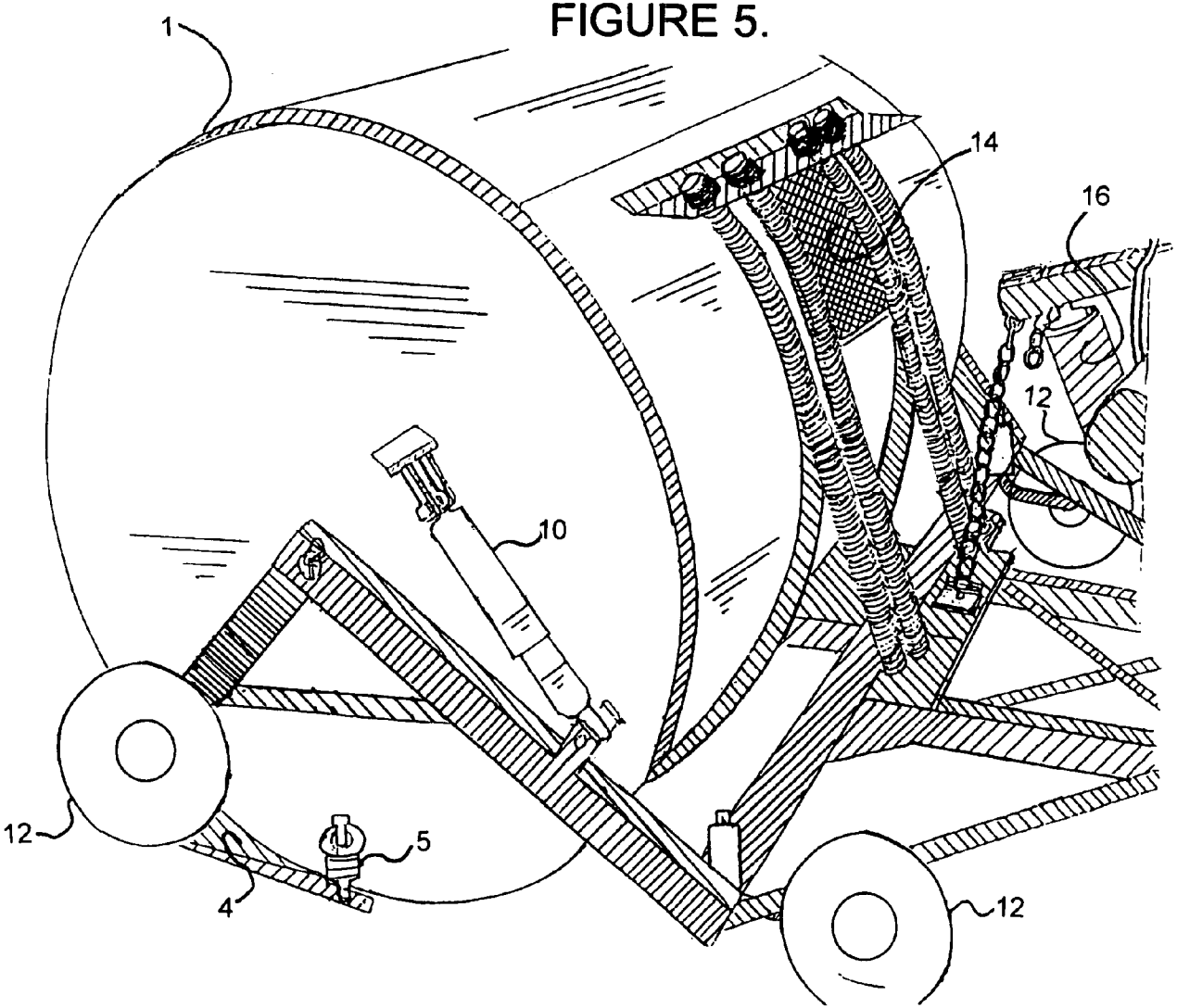
FIG. 5 is a closer rear oblique view that shows more details in the mounting to the front of a truck, and the shock absorbing means for this refuse collector. An inspection screen opening is shown that allows a visual means to indicate when the collector storage shelf is full and needs to be emptied.

The refuse collector [1] is shown in FIG. 5 with the prior cited features with the addition of the view of the usual mounting attachments for front mounted devices, typically snowplows and blades, wherein the impact absorbing springs are to be seen, and the framework that attaches to the propelling vehicle. In this oblique side view the hydraulic means [16] is shown as a lifting means for the refuse collector [1], and this hydraulic means can provide the motor means for the smaller, lower speed models as seen in FIGS. 6 through 10. The viewing means [14] is shown as a window view for the operator of the vehicle to see when the storage means is full, and as such a remote video means can provide for viewing when the accessory means are available that support this service.

Figure 6:
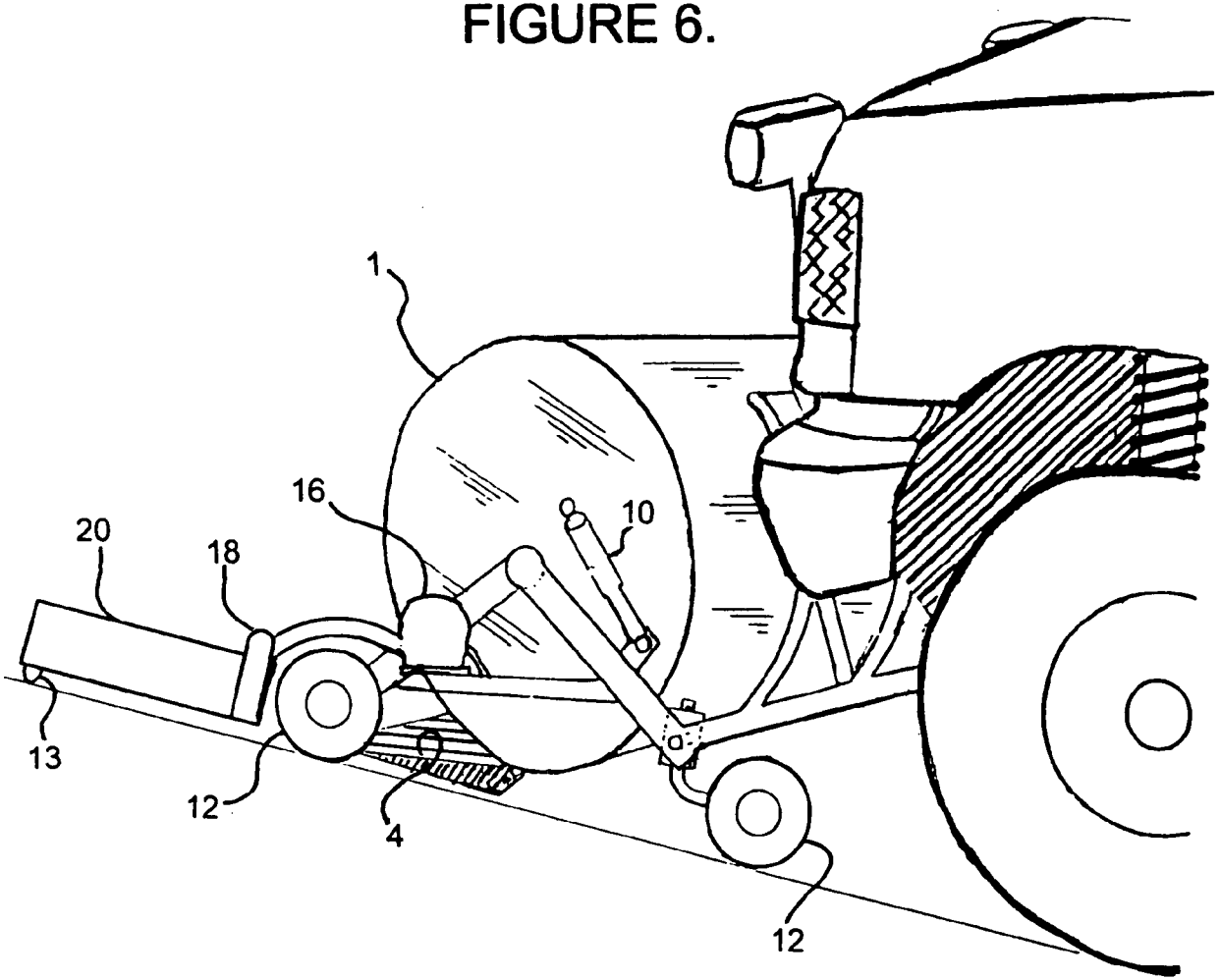
FIG. 6 is a rear oblique view of the refuse collector of a smaller version suitable for lower speed uses as in a city street; and the front mounted sweeps are shown that can gather into the refuse collector any debris encountered.
Figure 7:
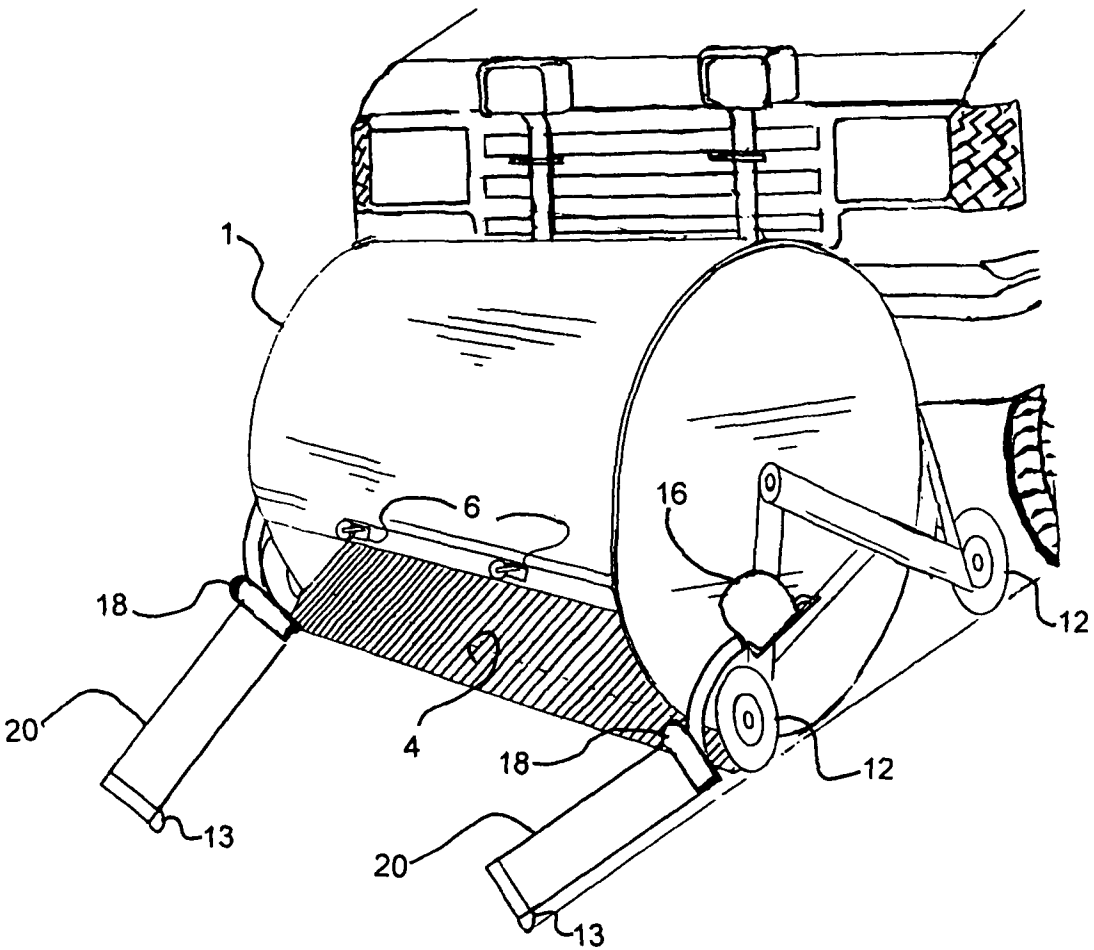
FIG. 7 is a front oblique view of the smaller version of the refuse collector mounted on the front of a truck ready to be put to work in a slower speed operation as in a city street. Two front mounted sweeps are shown that can rotate debris into the front opening of the refuse collector wherein in FIGS. 8, 9, & 10 will show a means to rotate such debris onto a storage shelf for later cleanout as needed.

In FIGS. 6 and 7 to follow the refuse collector [1] is shown at the smaller size for less than normal highway speeds, such is for use on a city street, parking lots, suburban and rural areas with slower speed service. In these instances wherein the heavy, high speed centrifugal forces are not available, the added front mounted sweeping arm [20] is seen powered by motor means [18] to rotate into the refuse collector [1]. At the lower front edge of the sweeping arm [20] can be seen smaller wheels/skids [13] that maintain a clearance above the road surface. In the motor means [18] shown is an arm that can be raised when not in service, and this assembly is shown powered by another motor [16] that rides upon the refuse collector [1]. The purpose of this assembly is to sweep refuse into the collector when the heavy, high speed centrifugal forces are not available. The collection of refuse and smaller debris by this assembly is to be found upon streets, roads, parking lots, suburban and rural slower speed roadways, even on occasions, unpaved sections, as well as, the highways and Interstate road systems.

In the slower speed collection mode, in the FIGS. 8, 9, and 10 can be seen the framework means [22] of the interior of the refuse collector [1] from the its rest position in FIG. 8, and into its rotating activity in FIG. 9, and then to its final delivery of refuse to the storage shelf [8] in FIG. 10. This framework [22] is to be motor driven as needed to facilitate the gathering of refuse and debris into storage where it will accumulate until full, and then driven to be unloaded at a trash service and collection facility.

The vehicle mounted highway refuse collector is my invention that can ease the roadway collection of refuse safely, and without undue risk to the highway workers, and undue risk to the average vehicles on the roadway. It can be seen that the discarded tire treads, and especially, the heavy truck tire treads, also known as "gators", contain wire, and heavy weights, and slippery casings, that can 'snake' along a highway surface and are a danger to the traffic on the highway. It is an object of my invention to gather these difficult items along with other heavy and dangerous refuse from the highway at normal road speeds so as not to disturb the routine traffic. Additionally, when these high speed impacts are not available, that in such cases, the smaller unit will need motor assistance to gather and store refuse safely. My invention provides safety and convenience to the highway workers and to the driving motorists. As you view these drawings and descriptions, an average of the best intended vehicle mounted highway refuse collector is presented that can develop over time to become the optimal invention that I have intended.

I hereby apply for a letters patent for my "Vehicle Mounted Highway Refuse Collector".

What is claimed is:

1. A vehicle mounted highway refuse collector comprising a means for gathering refuse from a highway while the vehicle is moving.

2. The refuse collector of claim 1 wherein the refuse collector is capable of collecting said refuse while said vehicle is moving at normal highway speeds, wherein normal highway speeds are 35 mph to 75 mph.

3. The refuse collector of claim 2 wherein the refuse collector is capable of gathering discarded tire treads from the highway surface at normal highway speeds.

4. The refuse collector of claim 2 wherein the refuse collector is capable of gathering dead animals from the highway surface at normal highway speeds.

5. The refuse collector of claim 2 wherein the refuse collector is capable of gathering most major debris from the highway surface at normal highway speeds.

6. The refuse collector of claim 1 further comprising a supporting means adjustable over the highway surface comprising an independent wheeled means.

7. The refuse collector of claim 1 wherein the refuse collector is capable of gathering said refuse from the highway surface at normal highway speeds without requiring any additional safety means and safety precautions, wherein normal highway speeds are 35 to 75 mph.

8. The refuse collector of claim 6 further comprising a visual access means to ascertain when cleanout of the gathered refuse is needed.

9. The refuse collector of claim 1, further comprising a means of absorbing impacts to said refuse collector device while said propelling vehicle is moving along the highway at speed, wherein normal highway speeds are 35 to 75 mph.

10. A vehicle mounted highway refuse collector comprising a means to gather refuse from highway surfaces while the vehicle is moving at less than normal speeds, wherein normal speeds are considered 35-75 mph.

11. The refuse collector of claim 10 further comprising a supporting means adjustable over highway surfaces comprising an independent wheeled means.

12. The refuse collector of claim 10 wherein the refuse collector is capable of gathering most major debris from the highway surfaces when at less than normal speeds.

13. The refuse collector of claim 10 further comprising a visual means to ascertain when cleanout of the gathered refuse is needed.

14. The refuse collector of claim 10, further comprising a means of absorbing impacts to said refuse collector device while said vehicle is moving along the highway at speed.

* * * * *